US008787584B2

(12) United States Patent
Nyström et al.

(10) Patent No.: US 8,787,584 B2
(45) Date of Patent: Jul. 22, 2014

(54) AUDIO METRICS FOR HEAD-RELATED TRANSFER FUNCTION (HRTF) SELECTION OR ADAPTATION

(75) Inventors: Martin Nyström, Hörja (SE); Markus Agevik, Malmö (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 497 days.

(21) Appl. No.: 13/167,807

(22) Filed: Jun. 24, 2011

(65) Prior Publication Data

US 2012/0328107 A1 Dec. 27, 2012

(51) Int. Cl.

| | |
|---|---|
| ***H04R 5/00*** | (2006.01) |
| ***H04R 3/00*** | (2006.01) |
| ***H04R 5/02*** | (2006.01) |

(52) U.S. Cl.

USPC ..... 381/17; 381/1; 381/26; 381/122; 381/310

(58) Field of Classification Search

CPC ..... H04S 1/002; H04S 5/00; H04S 7/304; H04S 7/303

USPC ..... 381/17, 310, 122, 1, 26

See application file for complete search history.

(56) References Cited

U.S. PATENT DOCUMENTS

| | | | | |
|---|---|---|---|---|
| 6,996,244 | B1 * | 2/2006 | Slaney et al. | 381/303 |
| 2012/0201405 | A1 * | 8/2012 | Slamka et al. | 381/307 |

* cited by examiner

*Primary Examiner* — Vivian Chin
*Assistant Examiner* — Douglas Suthers
(74) *Attorney, Agent, or Firm* — Snyder, Clark, Lesch & Chung, LLP

(57) ABSTRACT

A method includes detecting, via a first microphone coupled to a user's left ear, a sound, detecting, via a second microphone coupled to the user's right ear, the sound, determining a time difference between detection of the sound at the first microphone and detection of the sound at the second microphone, and estimating a user's head size based on the time difference. The method also includes identifying a head-related transfer function (HRTF) associated with the user's head size or modifying, a HRTF based on the user's head size. The method further includes applying the identified HRTF or modified HRTF to audio signals to produce output signals and forwarding the output signals to first and second speakers coupled to the user's left and right ears.

20 Claims, 12 Drawing Sheets

AUDIO METRICS FOR HEAD-RELATED TRANSFER FUNCTION (HRTF) SELECTION OR ADAPTATION

TECHNICAL FIELD OF THE INVENTION

The invention relates generally to audio technology and, more particularly, to head-related transfer functions.

DESCRIPTION OF RELATED ART

Audio devices having a pair of speakers, may realistically emulate three-dimensional (3D) audio emanating from sources located in different places. For example, digital signal processing devices may control the output to left ear and right ear speakers to produce natural and realistic audio sound effects.

SUMMARY

According to one aspect, a method comprises detecting, via a first microphone coupled to a user's left ear, a sound, and detecting, via a second microphone coupled to the user's right ear, the sound. The method also includes determining a time difference between detection of the sound at the first microphone and detection of the sound at the second microphone, estimating a user's head size based on the time difference, and at least one of identifying a head-related transfer function (HRTF) associated with the user's head size, or modifying, a HRTF based on the user's head size. The method further includes applying the identified HRTF or modified HRTF to audio signals to produce output signals, and forwarding the output signals to first and second speakers coupled to the user's left and right ears.

Additionally, the estimating a user's head size may comprise providing, via a user device, instructions to a user for estimating the user's head size, and receiving, by the first and second microphones and after the instructions are provided, sound generated by the user.

Additionally, the providing instructions may comprise instructing the user to make a sound or have another party make a sound at a location that is in a plane or along an axis that includes the user's left and right ears.

Additionally, the estimating a user's head size may comprise detecting, by the first and second microphones, a plurality of sounds over a period of time, determining a time difference between detection of each of the plurality of sounds by the first and second microphones, and estimating a head sized based on a maximum time difference.

Additionally, the at least one of identifying or modifying may comprise identifying a HRTF associated with the user's head size, wherein the identifying comprises accessing a memory storing a plurality of HRTFs, and identifying a first one of the plurality of HRTFs corresponding to the user's head size.

Additionally, the memory may be configured to store at least one of HRTFs corresponding to a small head size, a medium head size and a large head size, HRTFs corresponding to a plurality of different head diameters, or HRTFs corresponding to a plurality of different head circumferences.

Additionally, the method may further comprise determining, using the first and second microphones, a second user's head size, and accessing the memory to determine whether one of the plurality of HRTFs corresponds to the second user's head size.

Additionally, the method may further comprise at least one of generating a HRTF based on the second user's head size, in response to determining that none of the plurality of HRTFs stored in the memory corresponds to the second user's head size, or modifying one of the plurality of HRTFs based on the second user's head size, in response to determining that none of the plurality of HRTFs stored in the memory corresponds to the second user's head size.

Additionally, the method may further comprise determining the user's ear positions, and wherein the identifying a HRTF further comprises identifying the HRTF based on the user's ear positions.

Additionally, the identifying a HRTF may comprise accessing a memory storing a plurality of HRTFs, and identifying a first one of the plurality of HRTFs corresponding to the user's head size.

According to another aspect, a device comprises a memory configured to store a plurality of head-related transfer functions (HRTFs), each of the HRTFs being associated with a different head size. The device also comprises processing logic configured to receive time-related information associated with detecting a sound at a first microphone coupled to or located near a user's left ear, receive time-related information associated with detecting the sound at a second microphone coupled to or located near the user's right ear and determine a time difference between detection of the sound at the first microphone and detection of the sound at the second microphone. The processing logic is also configured to estimate a user's head size based on the time difference, at least one of identify a first HRTF associated with the user's head size, generate a first HRTF based on the user's head size, or modify an existing HRTF to provide a first HRTF based on the user's head size, and apply the first HRTF to audio signals to produce output signals. The device further comprises a communication interface configured to forward the output signals to first and second speakers configured to provide sound to the user's left and right ears.

Additionally, the processing logic may be further configured to output instructions for estimating the user's head size, and receive, by the first and second microphones and after the instructions are provided, sound generated by the user.

Additionally, when estimating a user's head size, the processing logic may be configured to receive, via the first and second microphones, time related information associated with detecting a plurality of sounds over a period of time, determine a time difference between detection of each of the plurality of sounds by the first and second microphones, and estimate a head sized based on a maximum time difference.

Additionally, the plurality of HRTFs may include at least HRTFs corresponding to a small head size, a medium head size and a large head size.

Additionally, the processing logic may be further configured to estimate, using the first and second microphones, head size information associated with a second user, and determine whether one of the plurality of HRTFs stored in the memory corresponds to the second user's head size.

Additionally, the processing logic may be further configured to at least one of generate a HRTF based on the second user's head size, in response to determining that none of the plurality of HRTFs corresponds to the second user's head size, or modify one of the plurality of HRTFs based on the second user's head size, in response to determining that none of the plurality of HRTFs corresponds to the second user's head size.

Additionally, the communication interface may be configured to receive the plurality of HRTFs from an external device, and the processing logic is configured to store the HRTFs received from the external device in the memory.

Additionally, the device may comprise a headset comprising a first speaker, a second speaker, a first microphone located adjacent the first speaker, and a second microphone located adjacent the second speaker.

Additionally, the device may comprise a mobile terminal.

According to still another aspect, a system comprises a headset comprising a right ear speaker, a left ear speaker, a first microphone coupled to the right ear speaker, and a second microphone coupled to the left ear speaker. The system also includes a user device configured to estimate a head size of a user wearing the headset based on a time difference associated with detection of sound received by the first and second microphones, and identify a head related transfer function (HRTF) to apply to audio signals provided to the right ear speaker and left ear speaker.

BRIEF DESCRIPTION OF THE DRAWINGS

The accompanying drawings, which are incorporated in and constitute part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements. As used herein, the term "body part" may include one or more other body parts.

Figure 1B:
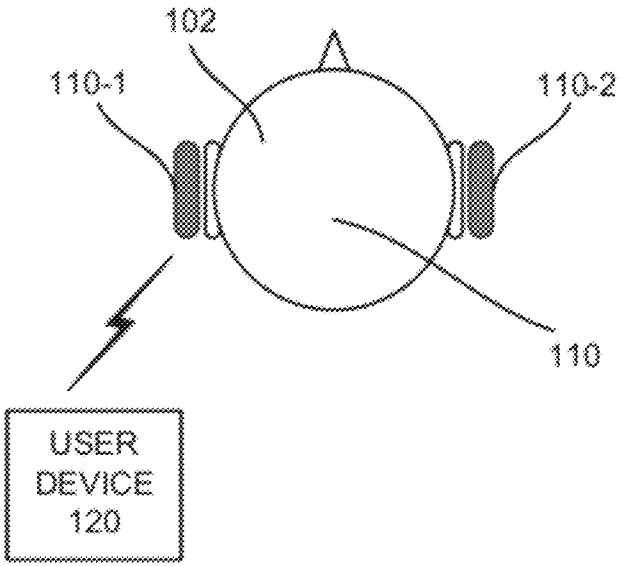
FIGS. 1A and 1B illustrate concepts described herein.
Figure 1A:
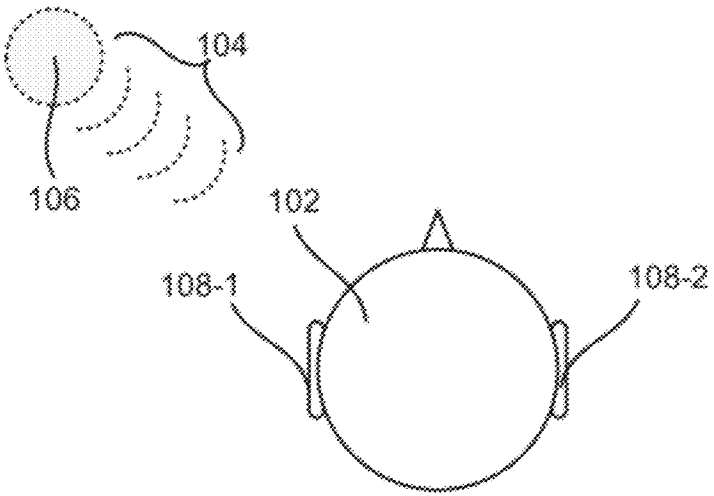

FIGS. 1A and 1B illustrates concepts described herein. FIG. 1A shows a user 102 listening to a sound 104 that is generated from a source 106. As shown, user 102's left ear 108-1 and right ear 108-2 may receive different portions of sound waves from source 106 for a number of reasons. For example, ears 108-1 and 108-2 may be at unequal distances from source 106, as illustrated in FIG. 1A. As a result, a sound wave may arrive at ears 108-1 and 108-2 at different times. As another example, sound 104 arriving at right ear 108-2 may have traveled a different path than the corresponding sound at left ear 108-1 due to different spatial geometry of objects (e.g., the direction in which right ear 108-2 points is different from that of left ear 108-1, user 102's head obstructs right ear 108-2, etc.). For example, portions of sound 104 arriving at right ear 108-2 may diffract around the user's head 102 before arriving at ear 108-2. These differences of sound detection may give the user the impression that the source of the sound being heard is from a particular distance and or direction. Natural hearing normally detects variation of a sound source's 106 directions and distances.

Assume that the extent of acoustic degradations from source 106 to left ear 108-1 and right ear 108-2 are encapsulated in or summarized by head-related transfer functions $H_L(\omega)$ and $H_R(\omega)$ for the left and right ears, respectively, where $\omega$ is frequency. Then, assuming that sound 104 at source 106 is $X(\omega)$, the sounds arriving at each of ears 108-1 and 108-2 can be expressed as $H_L(\omega)\cdot X(\omega)$ and $H_R(\omega)\cdot X(\omega)$.

FIG. 1B shows a pair of headphones with earpieces 110-1 and 110-2 (referred to herein collectively as headphones 110, headset 110 or earphones 110) that each include a speaker that is controlled by a user device 120 within a sound system. Assume that user device 120 causes earpieces 110-1 and 110-2 to generate signals $G_L(\omega)\cdot X(\omega)$ and $G_R(\omega)\cdot X(\omega)$, respectively, where $G_L(\omega)$ and $G_R(\omega)$ are approximations to $H_L(\omega)$ and $H_R(\omega)$. By generating $G_L(\omega)\cdot X(\omega)$ and $G_R(\omega)\cdot X(\omega)$, user device 120 and headphones 110 may emulate sound that is generated from source 106. The more accurately that $G_L(\omega)$ and $G_R(\omega)$ approximate $H_L(\omega)$ and $H_R(\omega)$, the more accurately user device 120 and headphones 110 may emulate sound source 106.

In some implementations, the sound system may obtain $G_L(\omega)$ and $G_R(\omega)$ by applying a finite element method (FEM) to an acoustic environment that is defined by the boundary conditions that are specific to a particular individual. Such individualized boundary conditions may be obtained by the sound system by deriving 3D models of user 102's head based on, for example, the size of user 102's head. In other implementations, the sound system may obtain $G_L(\omega)$ and $G_R(\omega)$ by selecting one or more pre-computed HRTFs based on the 3D models of user 102's head, including user 102's head size and the distance between user 102's ears. As a result, the individualized HRTFs may provide better sound experience than a generic HRTF.

For example, the HRTF attempts to emulate spatial auditory environments through filtering the sound source before it is provided to the use's left and right ears to emulate natural hearing. The closer that the HRTF matches the individual user's physical attributes (e.g. head size, ear positions etc.), the greater or more realistic the emulated spatial auditory experience will be for the user, as described in more detail below.

Figure 2:
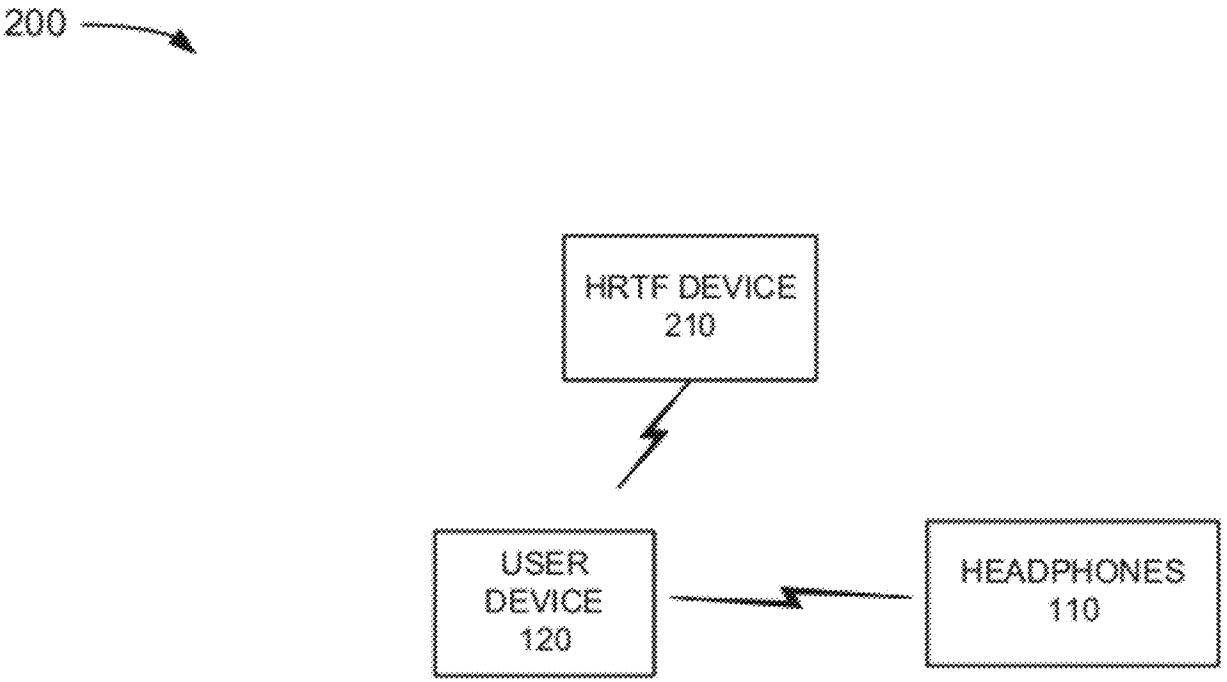
FIG. 2 illustrates an exemplary system in which concepts described herein may be implemented.

FIG. 2 illustrates an exemplary system 200 in which concepts described herein may be implemented. Referring to FIG. 2, system 200 includes headphones 110, user device 120 and HRTF device 210. Devices in system 200 may communicate with each other via wireless, wired, or optical communication links.

Headphones 110 may include a binaural headset that may be used by parties with various head sizes. For example, headphones 110 may include in-ear speakers or earbuds that fit into the ears of the users. In this implementation, headphones 110 may include left ear and right ear speakers (labeled 110-1 and 110-2 in FIG. 1B) to generate sound waves in response to the output signal received from user device 120. In other implementations, headphones 110 may include an over-the ear type headset or another type of headset with speakers providing left and right ear output. Headphones 110 may also include one or more microphones that may be used to sense sound and estimate the head size of a user currently wearing headphones 110. The head size information may be provided to user device 120 to customize the audio output provided to headphones 110, as described in more detail below.

User device 120 may include a personal computer, a tablet computer, a laptop computer, a netbook, a cellular or mobile telephone, a smart phone, a personal communications system (PCS) terminal that may combine a cellular telephone with data processing and/or data communications capabilities, a personal digital assistant (PDA) that includes a telephone, a music playing device (e.g., an MP3 player), a gaming device or console, a peripheral (e.g., wireless headphone), a digital camera, a display headset (e.g., a pair of augmented reality glasses), or another type of computational or communication device.

User device 120 may receive information associated with a user, such as a user's head size. Based on the head size, user device 120 may obtain 3D models that are associated with the user (e.g., a 3D model of the user's head, including the distance between the user's ears). User device 120 may send the 3D models (i.e., data that describe the 3D models) to HRTF device 210. In some implementations, the functionalities of HRTF device 210 may be integrated within user device 120.

HRTF device 210 may receive, from user device 120, parameters that are associated with a user, such as the user's head size, ear locations, distance between the user's ears, etc. Alternatively, HRTF device 210 may receive 3D model information corresponding to the user's head size. HRTF device 210 may select, derive, or generate individualized HRTFs for the user based on the received parameters (e.g., head size). HRTF device 210 may send the individualized HRTFs to user device 120.

User device 120 may receive HRTFs from HRTF device 210 and store the HRTFs in a database. In some implementations, user device 120 may pre-store a number of HRTFs based on different head sizes. User device 120 may dynamically select a particular HRTF based on, for example, the user's head size and apply the selected HRTF to an audio signal (e.g., from an audio player, radio, etc.) to generate an output signal. User device 120 may provide the output signal to headphones 110.

For example, user device 120 may include an audio signal component that generates audio signals to which user device 120 may apply a customized HRTF. User device 120 may then output the audio signals to headphones 110.

Depending on the implementation, system 200 may include additional, fewer, different, and/or a different arrangement of components than those illustrated in FIG. 2. For example, in one implementation, a separate device (e.g., an amplifier, a receiver-like device, etc.) may apply a HRTF generated from HRTF device 210 to an audio signal to generate an output signal. The device may send the output signal to headphones 110. In another implementation, system 200 may include a separate device for generating an audio signal to which a HRTF may be applied (e.g., a compact disc player, a digital video disc (DVD) player, a digital video recorder (DVR), a radio, a television, a set-top box, a computer, etc.). Also, system 200 may include various devices (e.g., routers, bridges, switches, gateways, servers, etc.) that allow the devices to communicate with each other.

Figures 3A, 3B:
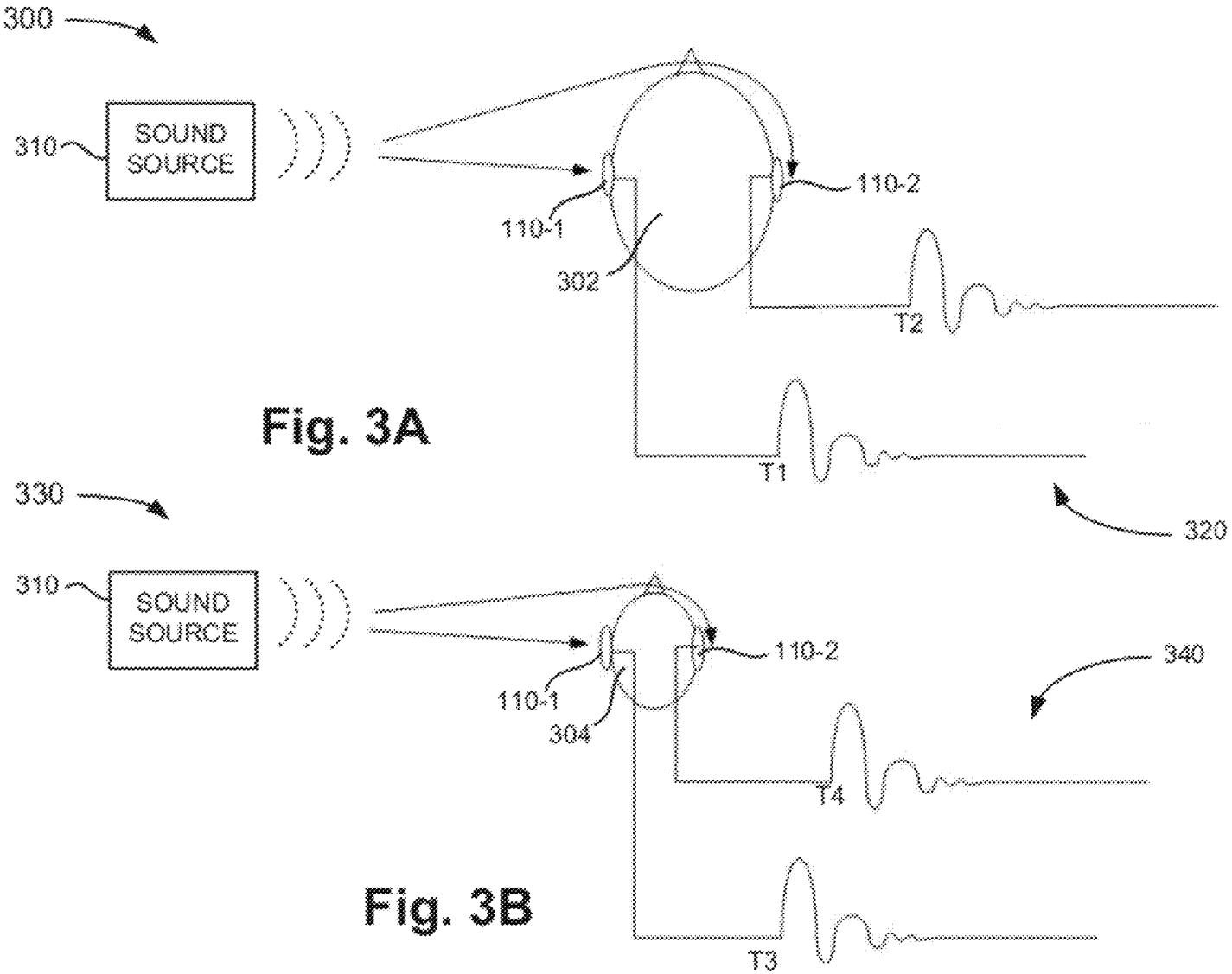
FIGS. 3A and 3B illustrate an exemplary embodiment associated with estimating the head size of a user.

FIGS. 3A and 3B illustrate exemplary environments associated with estimating head size of a user via headphones 110. In the implementation illustrated in FIGS. 3A and 3B, headset 110 may be an in-ear type headset including earpieces 110-1 and 110-2. In other implementations, headset 110 may be implemented via various other forms/types, such as an over-the-ear type headset, a neckband type headset, etc. Referring to FIG. 3A, environment 300 may include user 302 wearing headset 110, and sound source 310. Headset 110 may include earpieces 110-1 and 110-2 coupled to the ears of user 302. Earpieces 110-1 and 110-2 may each include a microphone that is able to detect sound. Earpieces 110-1 and 110-2 may also each include a speaker that provides sound to user 302. The speakers in earpieces 110-1 and 110-2 may generate sound for user 102's left and right ears in response to output signals received from user device 112.

As illustrated in FIG. 3A, sound source 310 located to the side of user 302's head may create a sound (illustrated by the dashed lines). The microphone in earpiece 110-1 may detect the sound at a time T1, as indicated in the output illustrated at area 320. The microphone in earpiece 110-2 may detect the sound at time T2, as also illustrated at area 320 in FIG. 3A. Based on the difference in the time that the microphones in earpieces 110-1 and 110-2 detected the sound (e.g., time T2 minus time T1), the head size of the user may be estimated. For example, assuming that sounds travels at approximately 1,126 feet per second, an estimate of the distance associated with one half the circumference of user 302's head (e.g., the distance around the head from earpiece 110-1 to earpiece 110-2) may be obtained by multiplying the time difference between T2 and T1 (in seconds) by 1,126 feet per second to arrive at a head size estimation.

As an example, assume that the time difference between T1 and T2 is 0.000888 seconds. In this case, based on a speed of sound of 1,126 feet per second, one half the circumference of the user's head would be estimated as approximately one foot or 12 inches (i.e., 0.000888 seconds×1,126 feet/second). The total circumference of the user's head would then be estimated as 24 inches (i.e., two times one half the circumference), which corresponds to a relatively large head size. For example, a head circumference of 24 inches corresponds to a head diameter of approximately 7.6 inches (i.e., $24/\pi$).

Similar calculations may be performed to estimate the head size of another user wearing headphones 110. For example, environment 330 illustrated in FIG. 3B includes sounds source 310 and user 304. The microphone in ear piece 110-1 may detect the sound from sound source 310 at time T3, as indicated in the output illustrated at area 340. The microphone in earpiece 110-2 may detect the sound from sound source 310 at time T4, as also illustrated at area 340 in FIG. 3B. Based on the difference in the time that the microphones in earpieces 110-1 and 110-2 detected the sound (e.g., time T4 minus time T3), the head size of the user may be estimated. For example, in the example in FIG. 3B, the difference in times T3 and T4 is less than the difference in FIG. 3A. That is, since the user 304's head size is smaller that user 302, the delay in the sound from sound source 310 reaching the microphone in earpiece 110-2 for user 304 is shorter than for user 302 illustrated in FIG. 3A.

As an example, assume that the time differential between T4 and T3 is 0.000814 seconds. In this case, based on a speed of sound of 1,126 feet per second, one half the circumference of the user's head would be estimated as 11 inches (i.e., 000814 seconds×1,126 feet/second). The total circumference of the user's head would then be approximately 22 inches or approximately 56 centimeters (cm), which corresponds to a medium head size (e.g., a head diameter of approximately 7.0 inches).

In this manner, microphones in earpieces 110-1 and 110-2 may be used to estimate the user's head size. In some implementations, the user may manually initiate the head size determination via a user interface associated with user device 120 and/or headphones 110. In other implementations, the head size determination may be dynamically determined. For example, a background process executing on headphones 110 may estimate the head size based on received sound information, as described in more detail below.

In addition, in the examples described above with respect to FIGS. 3A and 3B, it was assumed that the delay in time for sound from sound source 310 reaching earpiece 110-2 corresponds to a distance that equals approximately one half of the circumference of the user's head. That is, the sound is assumed to reach earpiece 110-2 after it diffracts around user 302 or user 304's head from the user's left ear to the user's right ear. In other implementations, more sophisticated algorithms may be used to estimate the extra distance of travel of sound from sound source 310 to earpiece 110-2. For example, based on the geometry (e.g., distance) of sound source 310 with respect to the user's head, in some implementations, the distance associated with the time delay for sound from sound source 310 reaching earpiece 110-2 may be assumed to be some fraction of one half the circumference of the user's head. That is, since the sound may not directly follow a path from the user's left ear to the user's right ear, some fraction of one half the circumference of the user's head may be considered to correspond to the time delay associated with sound reaching earpiece 110-2. In this case, the calculations described above may be adjusted accordingly.

As a simple example, if the added distance associated with the travel of the sound waves from the user's left ear to the user's right ear is estimated to correspond to 65% of one half the circumference of the user's head based on the location/geometry associated with sound source 310 with respect to the user's head and the user's head shape, the time differential (e.g., T2−T1, or T4−T3) may be multiplied by the speed of sound to get an estimate of 65% of one half the circumference of the user's head. The value corresponding to 65% of one half the circumference of the user's head may then be multiplied by 2/0.65 (about 3.08) to estimate the circumference of the user's head. In this manner, the time differential may be correlated to the geometry associated with the location of sound source 310 with respect to the user to obtain a more accurate estimation of the user's head size. In this example, the 65% value was taken as a simple example to illustrate that in some implementations, various factors, such as location from the sound source, head shape, etc., may be used to more accurately estimate the user's head size. Therefore, in other implementations, other fractions of one half the circumference of the user's head may be considered to correspond to the time delay associated with sound reaching earpiece 110-2, such as values ranging from, for example, 10% to 99%.

Figure 4:
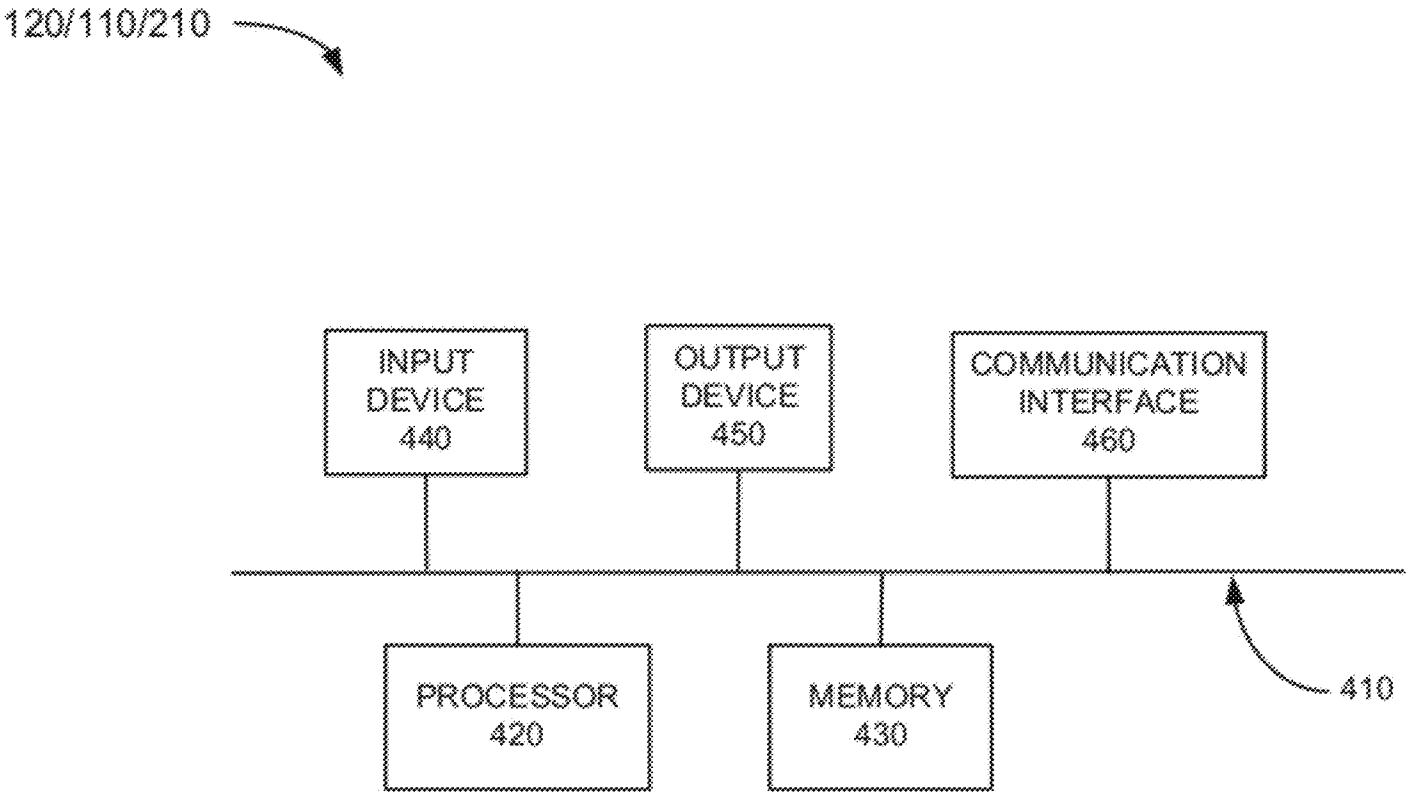
FIG. 4 is a block diagram of exemplary components of one or more of the devices of FIG. 2.

FIG. 4 is a diagram illustrating components of user device 120 according to an exemplary implementation. HRTF device 210 and headset 110 may be configured in a similar manner. User device 120 may include bus 410, processor 420, memory 430, input device 440, output device 450 and communication interface 460. Bus 410 permits communication among the components of user device 120 (or HRFT device 210, or headset 110). One skilled in the art would recognize that user device 120 may be configured in a number of other ways and may include other or different elements. For example, user device 120 may include one or more modulators, demodulators, encoders, decoders, etc., for processing data.

Processor 420 may include a processor, microprocessor, an application specific integrated circuit (ASIC), field programmable gate array (FPGA) or other processing logic. Processor 420 may execute software instructions/programs or data structures to control operation of user device 120.

Memory 430 may include a random access memory (RAM) or another type of dynamic storage device that stores information and instructions for execution by processor 420; a read only memory (ROM) or another type of static storage device that stores static information and instructions for use by processor 420; a flash memory (e.g., an electrically erasable programmable read only memory (EEPROM)) device for storing information and instructions; a hard disk drive (HDD); and/or some other type of magnetic or optical recording medium and its corresponding drive. Memory 430 may also be used to store temporary variables or other intermediate information during execution of instructions by processor 420. Instructions used by processor 420 may also, or alternatively, be stored in another type of computer-readable medium accessible by processor 420. A computer readable medium may include one or more memory devices.

Input device 440 may include mechanisms that permit an operator to input information to user device 120, such as a microphone, a keypad, control buttons, a keyboard (e.g., a QWERTY keyboard, a Dvorak keyboard, etc.), a gesture-based device, an optical character recognition (OCR) based device, a joystick, a touch-based device, a virtual keyboard, a speech-to-text engine, a mouse, a pen, a stylus, voice recognition and or biometric mechanisms, etc.

Output device 450 may include one or more mechanisms that output information to the user, including a display (e.g., a liquid crystal display (LCD)), a printer, one or more remotely located speakers, such as two or more speakers associated with headset 110, etc.

Communication interface 460 may include a transceiver that enables user device 120 to communicate with other devices and/or systems. For example, communication interface 460 may include a modem or an Ethernet interface to a LAN. Communication interface 460 may also include mechanisms for communicating via a network, such as a wireless network.

For example, communication interface 460 may include one or more radio frequency (RF) transmitters, receivers and/or transceivers and one or more antennas for transmitting and receiving RF data via a network. Such a network may include a cellular network, a public switched telephone network (PSTN), a local area network (LAN), a wide area network (WAN), a wireless LAN, a metropolitan area network (MAN), personal area network (PAN), a Long Term Evolution (LTE) network, an intranet, the Internet, a satellite-based network, a fiber-optic network (e.g., passive optical networks (PONs)), an ad hoc network, any other network, or a combination of networks.

User device 120 may receive information from headset 110 and generate or identify one or more individualized HRTFs to be applied to audio signals output to headset 110. The individualized HRTFs may be dynamically computed, selected from among a number of pre-computed HRTFs, and/or an augmented or modified HRTF which may be based upon a previously stored HRTF. In each case, the individualized HRTF may be applied to audio signals output to headset 110 to provide the desired audio sound effect.

User device 120 may perform these operations in response to their respective processors 420 executing sequences of instructions contained in a computer-readable medium, such as memory 430. Such instructions may be read into memory 430 from another computer-readable medium via, for example, communication interface 460. In alternative embodiments, hard-wired circuitry may be used in place of or in combination with software instructions to implement processes consistent with the invention. Thus, implementations described herein are not limited to any specific combination of hardware circuitry and software.

Figure 5:
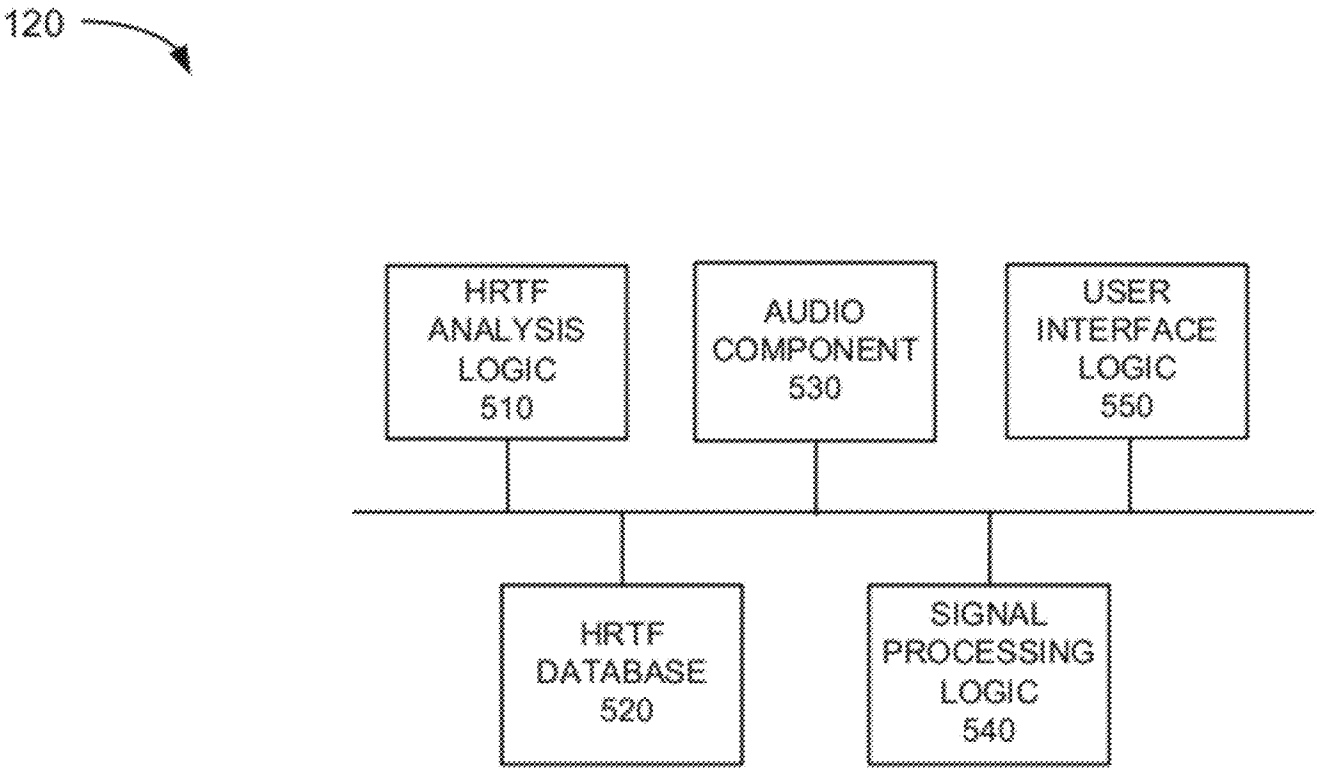
FIG. 5 is a block diagram of functional components implemented in the user device of FIG. 2 according to an exemplary implementation.

FIG. 5 is a block diagram of functional components of user device 120 in accordance with an exemplary implementation. Referring to FIG. 5, user device 120 may include HRTF analysis logic 510, HRTF database 520, audio component 530, signal processing logic 540 and user interface logic 550. All or some of the components illustrated in FIG. 5 may be implemented by processor 420 executing instructions stored in memory 430 of user device 120.

HRTF analysis logic 510 may obtain information from headset 110 regarding the head size of a user currently wearing headset 110. In some implementations, HRTF analysis logic 510 may also receive ear position information from headset, such as the distance between a user's ears, the location of the ear's with respect to the user's head (e.g., whether one ear is located higher on the user's head than the other ear). HRTF analysis logic 510 may select a particular HRTF based on the received information. In some implementations, HRTF analysis logic 510 may generate or augment pre-stored HRTF data based on information from headset 110 and store the new or modified HRTF in HRFT database 520.

HRTF database 520 may receive HRTFs from another component of device (e.g., HRFT device 210, HRTF analysis logic 510, etc.) and store the HRTFs along with corresponding identifiers. In one implementation, the identifier may be based on head size.

Figure 6:
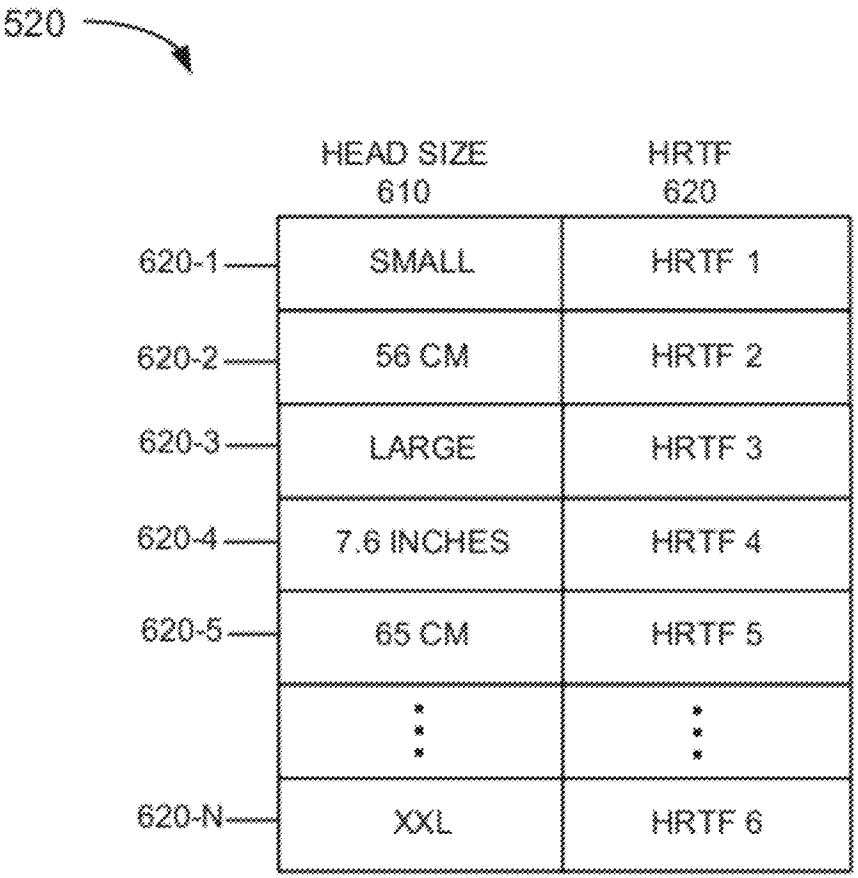
FIG. 6 is an exemplary table stored in the HRTF database of FIG. 5 according to an exemplary implementation.

For example, FIG. 6 illustrates an exemplary HRTF database 520. Referring to FIG. 6, database 520 may include a head size field 610 and an HRTF field 620. Head size field 610 may include information corresponding to various head sizes measured by headset 110. For example, entry 620-1 indicates a head size of "small," entry 620-2 indicates a head size of 56 cm (i.e., circumference of 56 cm) and entry 620-3 indicates a head size of "large." Entry 620-4 indicates a head size of 7.6 inches, which corresponds to the diameter of the user's head in inches, as opposed to the circumference in centimeters or inches. Therefore, HRTF database 520 may include relative head size information (e.g., small, medium, large, extra large), head size circumference information in, for example, centimeters, and head size diameter information in, for example, inches. This may allow HRTF database 520 to be used in connection with different types of headsets that provide various types of head size information.

HRTF field 620 may include identifiers associated with the corresponding entry in field 610. For example, field 620 of entry 620-1 indicates "HRTF 1." HRTF 1 may identify the particular HRTF to apply to audio signals output to a user with a measured "small" head size. Similarly, field 620 of entry 620-4 may identify HRTF 4. HRTF 4 may identify the particular HRTF to apply to audio signals output to a user with a head size diameter of approximately 7.6 inches.

Referring back to FIG. 5, audio component 530 may include an audio player, radio, etc. Audio component 530 may generate an audio signal and provide the signal to signal processing logic 540. In some implementations, audio component 530 may provide audio signals to which signal processing logic 540, which may apply a HRTF and/or other types of signal processing. In other instances, audio component 530 may provide audio signals to which signal processing logic 540 may apply only conventional signal processing.

Signal processing logic 540 may apply a HRTF retrieved from HRTF database 520 to an audio signal that is to be output from audio component 530 or a remote device, to generate an output audio signal. In some configurations (e.g., selected via user input), signal processing logic 540 may also apply other types of signal processing (e.g., equalization), with or without a HRTF, to the audio signal. Signal processing logic 540 may provide the output signal to another device, such as left and right ear speakers of headset 110, as described in more detail below.

User interface logic 550 may output information to a user via output device 450 (e.g., an LCD) to provide information to the user regarding determining his/her head size. For example, user interface logic 550 may output instructions to the user to enable headset 110 and/or user device 120 to determine the user's head size, as described in more detail below.

Figure 7:
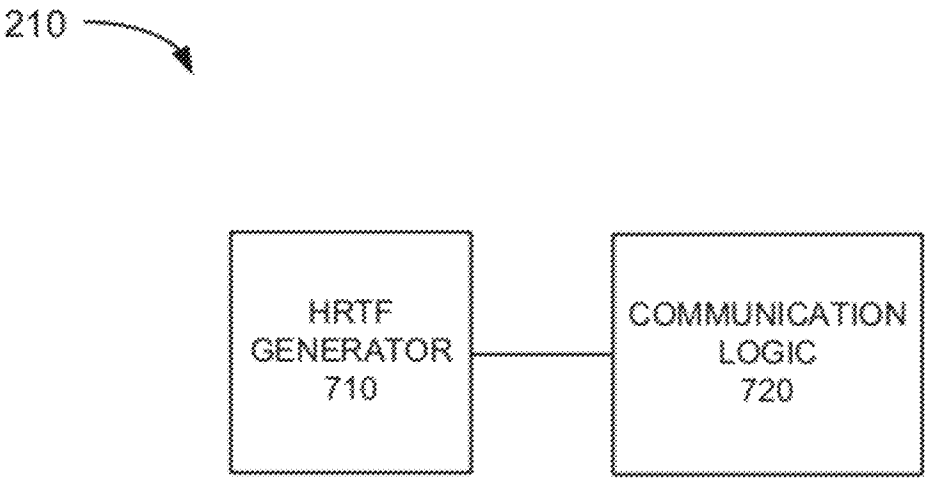
FIG. 7 is a block diagram of functional components implemented in the HRTF device of FIG. 2 in accordance with an exemplary implementation.

FIG. 7 is a functional block diagram of HRTF device 210. Referring to FIG. 7, HRTF device 210 may include HRTF generator 710 and communication logic 720. In some implementations, HRTF generator 710 may be implemented by processor 420 executing instructions stored in memory 430 of HRTF device 210. In other implementations, HRTF generator 710 may be implemented in hardware or a combination of hardware and software.

HRTF generator 710 may receive user-related information, such as head size information from user device 120, a 3-D model of a user's head, etc. In cases where HRTF generator 710 receives the head size information, as opposed to 3D models of a user's head, HRTF generator 710 may generate information pertaining to a 3D model based on the head size information.

HRTF generator 710 may select HRTFs, generate HRTFs, or obtain parameters that characterize the HRTFs based on information received from user device 120. In implementations or configurations in which HRTF generator 710 selects the HRTFs, HRTF generator 710 may include pre-computed HRTFs. HRTF generator 710 may use the received information (e.g., head size information provided by user device 120) to select one or more of the pre-computed HRTFs. For example, HRTF generator 710 may characterize a head size as large (as opposed to medium or small), having an egg-like shape (e.g., as opposed to circular). Based on these characterizations, HRTF generator 710 may select one or more of the pre-computed HRTFs.

In some implementations, HRTF generator 710 may receive additional or other information associated with a body part (e.g., ears) to further customize the generation or selection of HRTFs associated with various head sizes. Alternatively, HRTF generator 710 may refine or calibrate (i.e., optimize values of coefficients or parameters associated with the HRTF) the particular HRTFs based on information provided by user device 120.

As described above, in some implementations, HRTF generator 710 may compute the HRTFs or HRTF related parameters. In these implementations, HRTF generator 710 may apply, for example, a finite element method (FEM), finite difference method (FDM), finite volume method, and/or another numerical method, using the head size or 3D models of the head size as boundary conditions. This information may allow HRTF generator 710 to generate customized HRTFs corresponding to users' head sizes.

Once HRTF generator 710 generates HRTFs, HRTF generator 710 may send the generated HRTFs (i.e., or parameters that characterize transfer functions (e.g., coefficients of rational functions)) to another device (e.g., user device 120) via communication logic 720. For example, communication logic 720 may include one or more transceivers for communicating with communication interface 460 of user device 120 via wired or wireless mechanisms.

Depending on the implementation, HRTF device 210 may include additional, fewer, different, or different arrangement of functional components than those illustrated in FIG. 7. For example, HRTF device 210 may include an operating system, applications, device drivers, graphical user interface components, databases (e.g., a database of HRTFs), communication software, etc.

Figure 8:
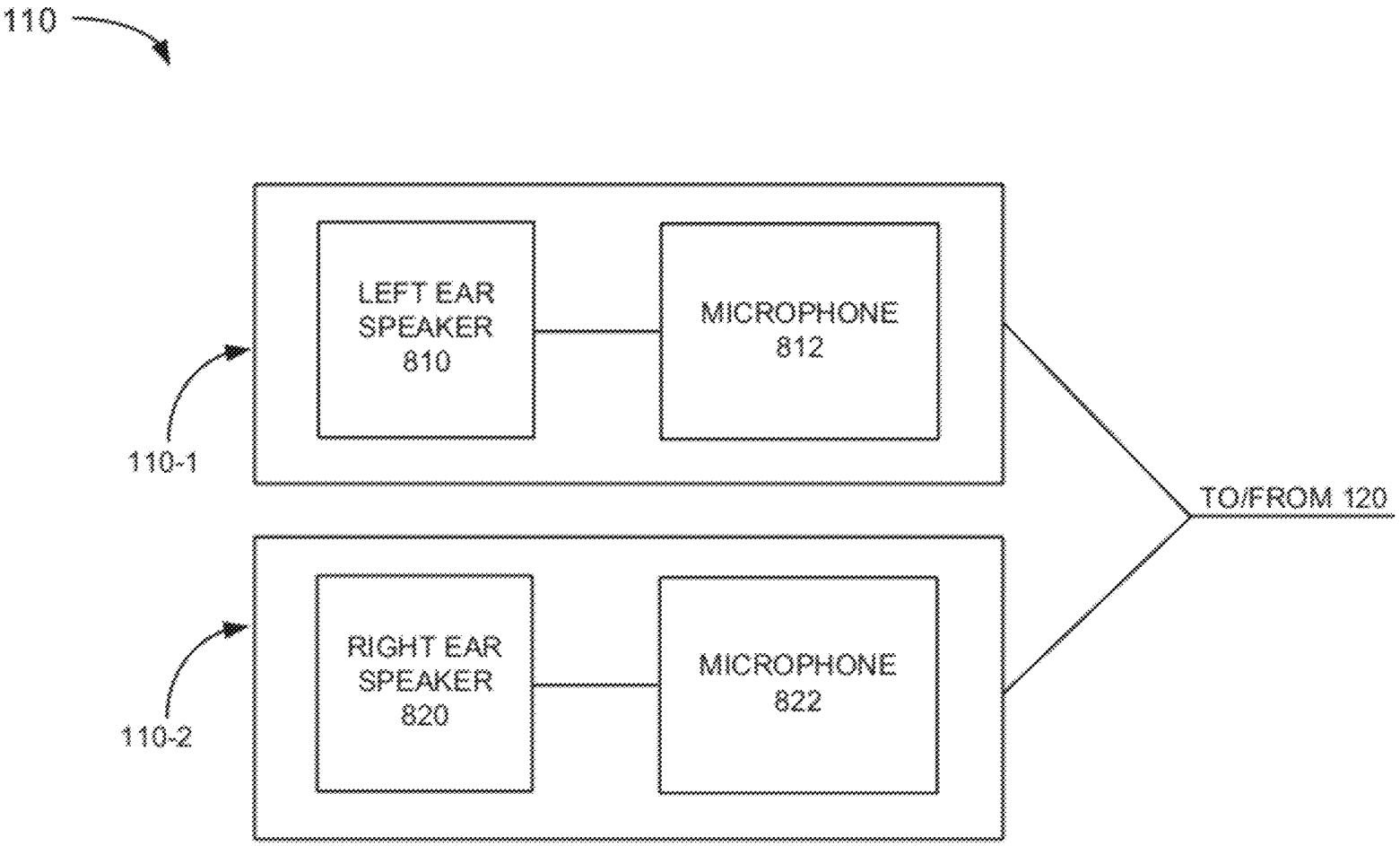
FIG. 8 is a block diagram of components implemented in the headphones of FIG. 2.

FIG. 8 is a functional block diagram of headphones 110. As described above, headphones 110 may be a binaural device that includes left ear speaker 810 and right ear speaker 820. Headphones 110 may also include microphone 812 and microphone 822. Microphones 812 and 822 may be mechanically and/or electrically attached to speakers 810 and 820, respectively. Alternatively, microphones 812 and 814 may be integrated within a housing that includes speakers 810 and 820, respectively. In each case, microphones 812 and 822 may be located adjacent to or within a user's ear canal (e.g., attached to earbuds).

In one implementation, microphones 812 and 822 may detect sounds associated with estimating a user's head size and communicate time information associated with the detected sounds to user device 120. User device 120 may then use the time information to estimate the user's head size, as discussed in more detail below.

Figure 9:
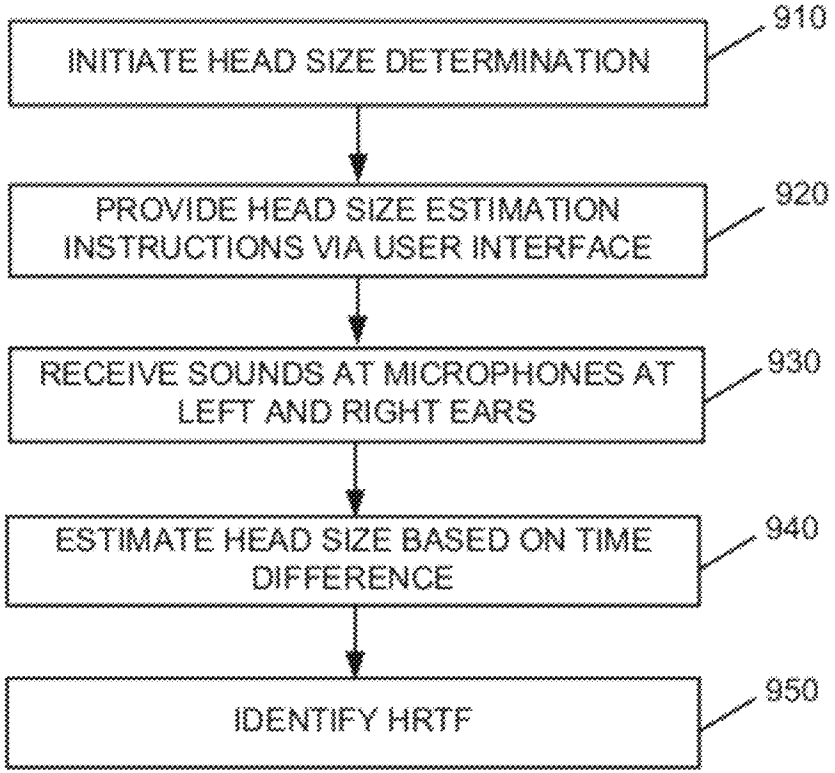
FIG. 9 is a flow diagram illustrating exemplary processing associated with estimating user head size in accordance with an exemplary implementation.

FIG. 9 is a flow diagram of an exemplary process for estimating a user's head size and providing audio output using an individualized HRTF. Processing may begin when a user activates or turns on headset 110 and/or user device 120. For example, a user may place headset 110 on his/her head and turn on user device 120 to listen to music.

Upon activation and detection of the headset 110, user device 120 may initiate a head size determination (block 910). For example, in one implementation, user interface logic 550 (FIG. 5) of user device 120 may output information associated with determining the user's head size upon detection of headset 110 being coupled to user device 120 and/or turned on. As an example, user interface logic 550 may display, via output device 450 (e.g., an LCD), a query asking the user whether he/she would like to initiate a head size determination process.

Assume that the user answers "yes" to the query. In this case, user interface logic 550 may provide instructions to the user for approximating the user's head size (block 920). As an example, user interface logic 550 may output instructions, via output device 450, indicating that the user is to place his/her left arm at his/her side such that the user's left hand is located in a plane that includes the user's left and right ears. For example, the instructions may tell the user to extend his/her arm such that the user's hand is aligned with both the user's left and right ears. Alternatively, the instructions may instruction to the user to place his/her left hand a certain distance (e.g., approximately 12 inches) from his/her left ear such that the user's hand is aligned with the user's left and right ears. The instructions may also instruct the user to snap the fingers on his/her left hand while the user's left arm is aligned with the user's left and right ears.

Assume that the user makes the desired sound (e.g., snaps his/her fingers). At this position, microphones 812 and 822 (FIG. 8) may detect the time at which the sound from the snapping fingers reaches each of the respective microphones (block 930).

For example, similar to FIG. 3A, assume that user 302 is wearing headphones 110, which include earpieces 110-1 and 110-2. As described above with respect to FIG. 8, each of earpieces 110-1 and 110-2 may include a speaker and a microphone. In an exemplary implementation, microphones 812 and 822 may forward timing information indicating when the sound was detected to user device 120. Alternatively, microphones 812 and 822 may output the sound information to user device 120. In this case, user device 120 may determine the time difference associated with receiving sound at microphones 812 and 822. In either case, use device 120 may estimate user 302's head size based on the receiving timing or sound information (block 940). For example, as described above with respect to FIG. 3A, assume that the time difference between detecting the sound at microphone 812 and microphone 822 is 0.000888 seconds, which corresponds to a head diameter of 7.5 inches.

In other implementations, headset 110 may determine the head size information and forward the head size information to user device 120, as opposed to forwarding the "raw" timing associated with the detection of the sounds at microphones 812 and 822 (or the sound information itself). In each case, the user's head size may be estimated based on the time difference associated with detecting sounds in microphones 812 and 822. User device 120 may then identify an HRTF based on the determined head size (block 950), as described in more detail below.

In another implementation, headset 110 may automatically estimate a user's head size based on the detection of sounds as the user wears headset 110. That is, user device 120 may not provide instructions to the user and headset 110 may automatically determine the head size as a background process that operates without user input, as described in detail below.

Figure 10:
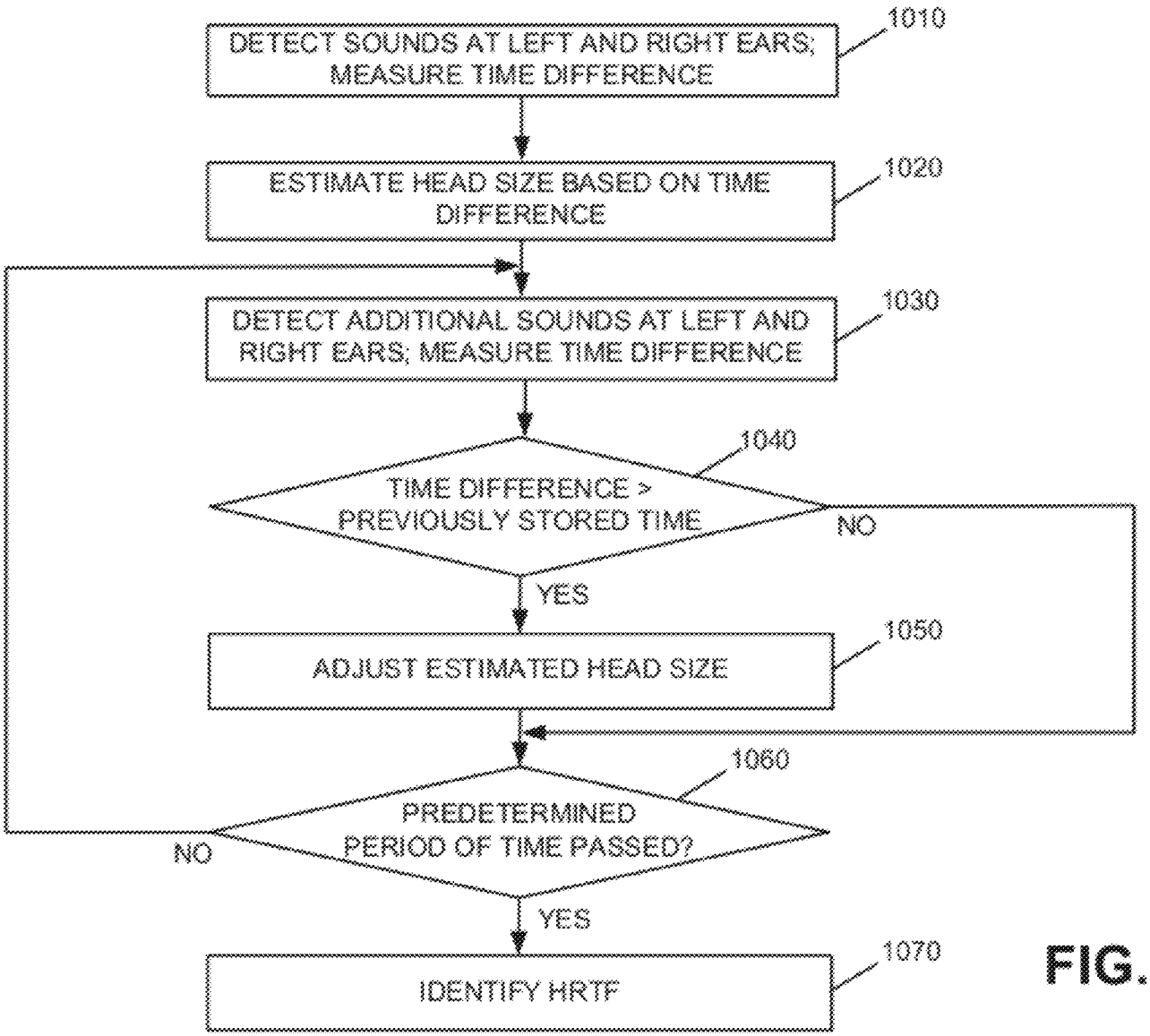
FIG. 10 is a flow diagram illustrating exemplary processing associated with estimating user head size in accordance with another implementation.

FIG. 10 is a flow diagram of an exemplary process for estimating a user's head size and providing audio output in accordance with another implementation. Processing may begin with microphones 812 and 822 located in earpieces 110-1 and 110-2 detecting sounds as user is wearing headset 110 (block 1010). Headset 110 (or user device 120) may measure the time difference between the time when microphone 812 detects the sound and the time when the microphone 822 detects the sound (block 1010).

In this example, assume that headset 110 forwards the raw timing information to user device 120. User device 120 may then determine the time difference between detection of sound at microphones 812 and 822 and estimate the user's head size based on the time difference (block 1020). User device 120 may store the time difference and/or estimated head size in memory 430 (FIG. 4). In this implementation, user device 120 (or headset 110) assumes that the maximum time difference will occur when a detected sound originates at a location in a plane or along an axis that includes the user's left and right ears. In other words, the maximum time difference will occur when the sound source is located perpendicular to the direction at which the user's nose/eyes are oriented.

Figure 11:
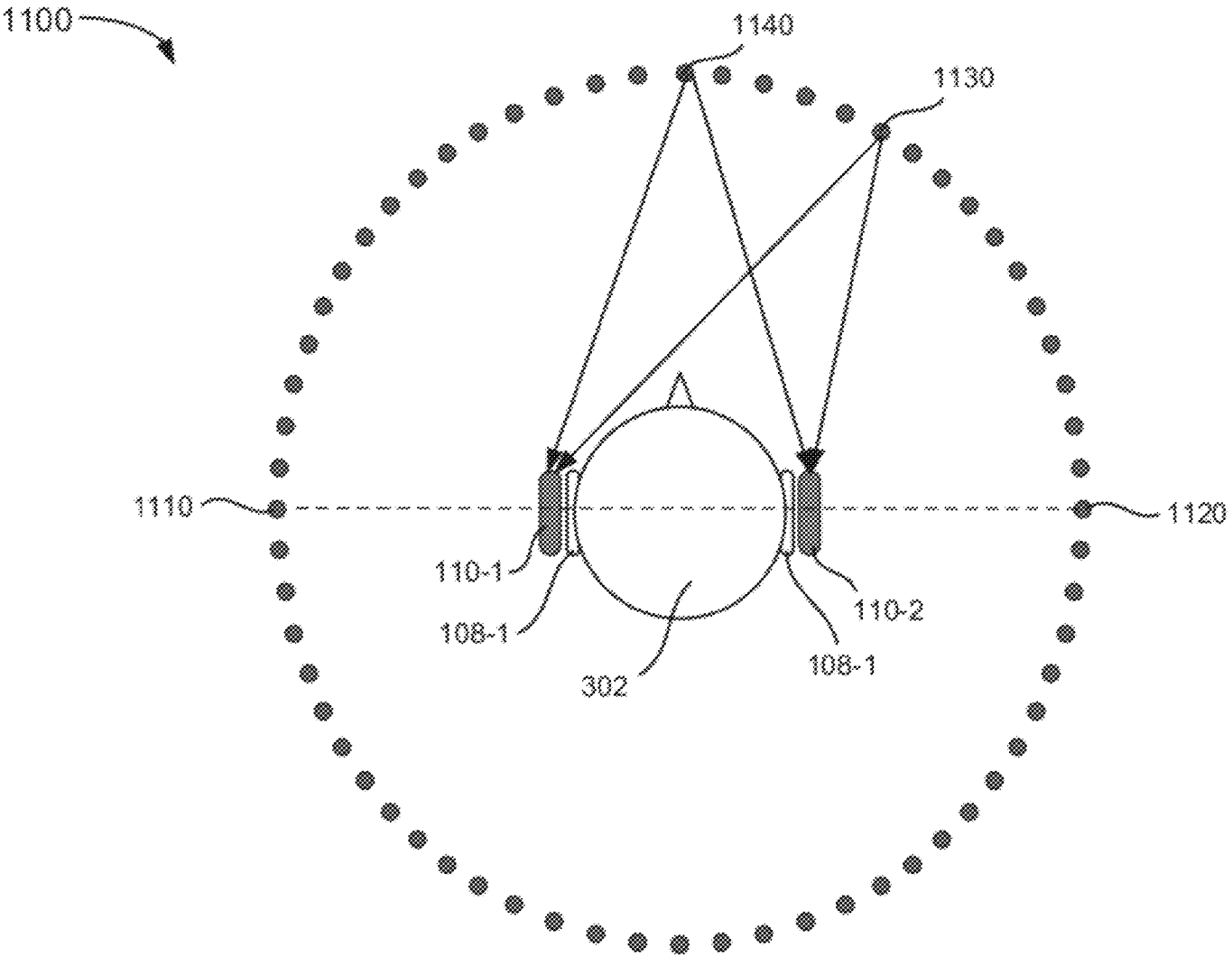
FIG. 11 is a diagram associated with the processing described in FIG. 10.

For example, FIG. 11 illustrates an environment 1100 that includes user 302 wearing headphones 110 including earpieces 110-1 and 110-2. The circles in FIG. 11 located around user 302 represent locations at which sound may be produced. In environment 1100, the maximum time difference between sounds detected at earpiece 110-1 and 110-2 will occur when a sound is detected from a source at location 1110 or 1120. That is, the maximum time difference will occur when the sound source is located in a same plane or on a same axis as the user's left and right ears (and is perpendicular to the orientation of the user's nose and/or eyes), as indicated by dashed line in FIG. 11.

As an example, assume that the first sound detected by headset 110 is from a source at location 1130. In this case, an estimate of the user's head size based on the time difference between detecting the sound at earpieces 110-1 and 110-2 would not be an accurate estimate since sound source 1130 is not located along the dashed line illustrated in FIG. 11. User device 120, however, may store the time difference and/or the calculated head size in memory 430.

Headset 110 may continue to detect sounds at left and right earpieces 110-1 and 110-2 (block 1030). For example, headset 110 may continue to detect and measure the time difference between the detection of sound at earpieces 110-1 and 110-2 until it can be expected that a sound will be received from a sound source located along the dashed line in FIG. 11 (e.g., at location 1010 or 1020).

Headset 110 may also forward the timing-related information to user device 120. User device 120 may measure the time difference between the detection of the sounds at left and right earpieces 110-1 and 110-2 (block 1030). User device 120 may also determine whether the measured time difference is greater than the previously stored time difference (block 1040). If the measured time difference associated with the recently received sound is greater than the previously measured time difference (block 1040—yes), user device 120 may store the new time difference in memory 430 and adjust the estimated head size (block 1050). For example, user device 120 may estimate the head size as described above with respect to FIGS. 3A and 3B. If the time difference is not greater than the previously stored time difference (block 1040—no), processing may continue at block 1060 described below. For example, referring to FIG. 11, if sound from a sound source at location 1140 is detected, the time difference associated with detecting the sound at earpieces 110-1 and 110-2 will be zero since the distance from location 1140 to earpieces 110-1 and 110-2 is the same, as illustrated by lines connecting location 1140 to earpieces 110-1 and 110-2. In this case, processing may continue at block 1060 with no new timing information or head size data being stored.

User device 120 may determine whether a predetermined period of time has passed since headset 110 began receiving sounds via earpieces 110-1 and 110-2 (block 1060). The predetermined period of time may be set to estimate an amount of time in which it would be expected that a sound located on a same axis/in a same plane as the user's left and right ears (e.g., at location 1110 or 1120) would have been received by microphones 812 and 822. For example, in one implementation, the time period may range from one minute to several minutes (e.g., one minute, three minutes, five minutes, ten minutes, etc.)

If the predetermined period of time has not passed (block 1060—no), processing may continue at block 1030. If, however, the predetermined period of time has passed (block 1060—yes), user device 120 may estimate the user's head size based on the longest time difference associated with detecting sound at the user's left and right ears. User device 120 may also select an individualized HRTF based on the user's head size (block 1070).

As discussed above, headset 110 may detect sounds at earpieces 110-1 and 110-2 coupled to the user's ears. User device (or headset 110) may use this information to estimate the user's head size. User device 120 may then identify an appropriate HRTF based on the estimated head size, as described in detail below.

Figure 12:
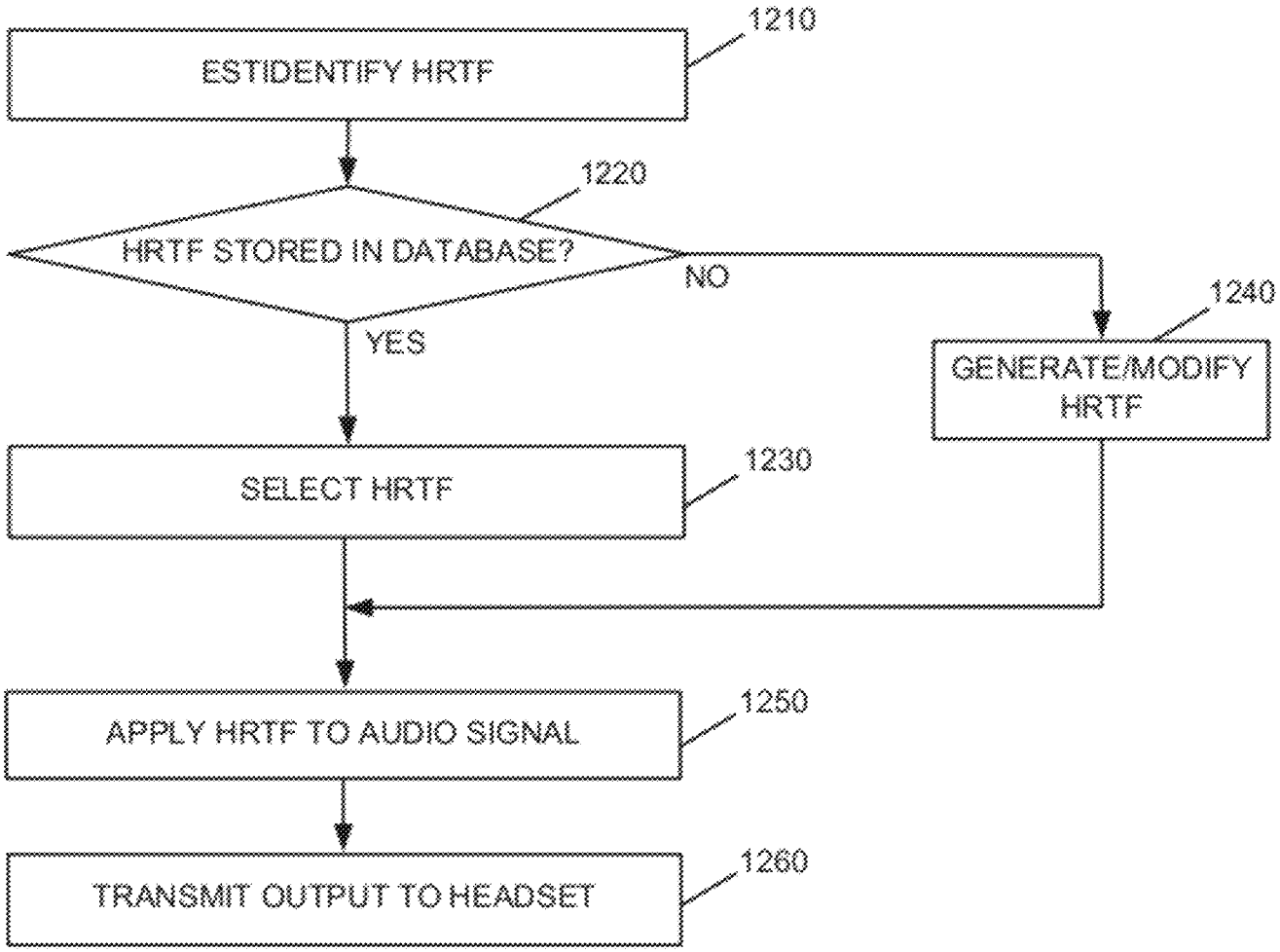
FIG. 12 is a flow diagram associated with providing an individualized HRTF to the user based on the user's head size.

FIG. 12 illustrates exemplary processing associated with identifying, selecting, augmenting or generating an HRTF that is based on the user's head size. Processing may begin with user device 120 generating the estimated head size and identifying an HRTF corresponding to the estimated head size (block 1210). For example, user device 120 may generate an estimated head size as described above with respect to FIG. 9 or FIG. 10.

HRTF analysis logic 510 may then determine whether the appropriate HRTF associated with the user's head size is stored in HRTF database 520 (block 1220). For example, continuing with the example above in which the diameter of the user's head size is estimated as 7.6 inches, HRTF analysis logic 510 may access HRTF database 520 and identify entry 620-4 as corresponding to a head size of 7.6 inches. In this case, HRTF analysis logic 510 may identify and select HRTF 4 as being the corresponding HRTF associated with the 7.6 inch head size (block 1230).

Alternatively, if HRTF analysis logic 510 does not identify an appropriate HRTF stored in HRTF database 520 for the user's particular head size (block 1220—no), HRTF analysis logic 510 may generate or augment an existing HRTF stored in HRTF database 520 (block 1240). For example, HRTF analysis logic 510 may modify various parameters associated with one of the HRTFs stored in HRTF database 520 to modify the HRTF for the 7.6 inch head size. In one implementation, HRTF analysis logic 510 may identify the closest head size to the measured head size and the HRTF corresponding to the closest measured head size. HRTF analysis logic 520 may then transform the closest HRTF using, for example, an FEM, FDM, finite volume method, or another numerical method, using the actual measured head size information.

In another implementation, HRTF analysis logic 510 may use the head size information as an input to generate or augment an existing HRTF. For example, an HRTF function stored by HRTF analysis logic 510 may include a head size parameter as an input to generate an HRTF "on the fly" for the user's estimated head size. In this case, HRTF analysis logic 510 and/or signal processing logic 540 may use the measured head size as an input to an HRTF function to generate an HRTF output that is appropriate/customized for the particular user's head size.

Alternatively, HRTF analysis logic 510 may forward the head size information to HRTF device 210. In this case, HRTF generator 710 may generate an HRTF or augment/adapt an existing HRTF based on the received head size information. HRTF generator 710 may forward the generated HRTF to user device 120 via communication logic 720 for storing in HRTF database 520.

In each case, assume that the appropriate HRTF is identified or generated. Signal processing logic 540 may then apply the selected HRTF to the audio source or audio signal to be provided to headset 110 (block 1250). User device 120 may then output the HRTF-modified audio signal to headset 110 (block 1260). That is, user device 120 may output a left ear signal and right ear signal to left ear speaker 810 and right ear speaker 820, respectively. In this manner, the audio signals provided to the right ear and left ear speakers in earpieces 110-1 and 110-2 are processed in accordance with the selected HRTF.

CONCLUSION

Implementations described herein provide a customized audio experience by estimating a user's head size based on timing related information, and selecting a customized HRTF based on a user's head size. The selected HRTF may then be applied to the speakers providing sound to the user's left and right ears to provide realistic sounds that more accurately emulate the originally produced sound. That is, the generated sounds may be perceived by the user as if the sounds were produced by the original sound sources, at specific locations in three dimensional spaces.

The foregoing description of implementations provides illustration, but is not intended to be exhaustive or to limit the implementations to the precise form disclosed. Modifications and variations are possible in light of the above teachings or may be acquired from practice of the teachings.

For example, in the above, user device 120 is described as applying an HRTF to an audio signal. In other implementations, headset 110 may perform these functions. That is, headset 110 may store a number of HRTFs and may also include processing logic to identify and apply one of the HRTFs to the audio signals based on the user's head size information. Headset 110 may then provide the HRTF processed audio signals to the left ear and right ear speakers.

In addition, features have been described above with respect to detecting sounds at microphones coupled to or located adjacent a user's left and right ears and estimating a head size using time correlation associated with when the sound was detected at each of the microphones. It should be understood that the quality of the captured sound must be of sufficient quality to enable user device 120 (or headset 110) to make a reasonable head size estimate. In some implementations, a discriminator or filter is used to ensure that an adequate sound pulse is detected by the microphones before performing any timing-related calculations.

Further, in some implementations, user device 120 (or headset 110) may check each calculated time difference associated with receiving sound impulses at the left and right microphones (e.g., microphones 812 and 822) and/or check the corresponding estimated head size to ensure that the estimated head size is within reasonable upper and lower limits associated with human head sizes. That is, if user device 120 generates an estimated head size of 12 inches in diameter, user device 120 may ignore this estimate as being outside the predefined limits or erroneous since a human would not be expected to have a 12 inch diameter head.

Still further, in the implementation described above with respect to FIG. 10, various head size estimates were described as being generated before an appropriate HRTF is identified. In other implementations, each time that a head size estimate is made, user device 120 may identify an appropriate HRTF based on the estimated head size. As additional sound information is received, user device 120 (or headset 110) may adapt/change the identified HRTF over time as additional, more accurate head size estimations are generated.

In addition, features have been mainly described above with respect to in-ear type headphones. In other implementations, over-the-ear type headphones may be used. As still another example, an eyeglass type device or head mount display worn by a user may include headphones. In these implementations, microphones located on the side pieces of the eyeglasses may be used to capture sounds to estimate the head size of the user.

Further, features have been described above mainly with respect to measuring/estimating head size (e.g., circumference, diameter, etc.). In some implementations, head shape estimations, ear location estimations, etc., may also be used, or may be used to augment the head size information when identifying an appropriate HRTF for the user. In these implementations, HRTF database 720 may include additional head-related information. As an example, field 610 in HRTF database 520 (or another field in HRTF database 520) may include relative ear height information, head shape information (e.g., round, egg-like, long, narrow, etc.). HRTFs corresponding to these different head related parameters (e.g., shape, size, etc.) may also be stored in HRFT database 520 to allow for HRTFs that are more tailored/customized to the different users.

Still further, features have been described above with respect to dynamically measuring head size and selecting an HRTF based on the measured head size. In other implementations, user device 120 may provide a user interface that allows the user to select his/her particular head size. For example, user device 120 may include a graphical user interface (GUI) that outputs information to a user via output device 450 (e.g., a liquid crystal display (LCD) or another type of display). The GUI may prompt the user to enter his/her head size (e.g., small, medium large, a particular size in centimeters or inches, etc). HRTF analysis logic 510 may receive the selection and select an appropriate HRTF from HRTF database 520 based on the user-provided information. Such an implementation may be useful in situations where the headphones do not include any microphones.

It will also be apparent that aspects described herein may be implemented in many different forms of software, firmware, and hardware in the implementations illustrated in the figures. The actual software code or specialized control hardware used to implement aspects does not limit the invention. Thus, the operation and behavior of the aspects were described without reference to the specific software code—it being understood that software and control hardware can be designed to implement the aspects based on the description herein.

Further, although details of generating HRTFs based on the particular head sizes is not described in detail herein, any number of methods of generating the customized HRTFs may be used.

It should be emphasized that the term "comprises/comprising" when used in this specification is taken to specify the presence of stated features, integers, steps or components but does not preclude the presence or addition of one or more other features, integers, steps, components, or groups thereof.

Further, certain portions of the implementations have been described as "logic" that performs one or more functions. This logic may include hardware, such as a processor, a microprocessor, an application specific integrated circuit, or a field programmable gate array, software, or a combination of hardware and software.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A method comprising:

detecting, via a first microphone coupled to a user's left ear, a sound;

detecting, via a second microphone coupled to the user's right ear, the sound;

determining a time difference between detection of the sound at the first microphone and detection of the sound at the second microphone;

estimating a user's head size based on the time difference;

at least one of:

a) identifying a head-related transfer function (HRTF) associated with the user's head size, or b) modifying, a HRTF based on the user's head size;

applying the identified HRTF or modified HRTF to audio signals to produce output signals; and forwarding the output signals to first and second speakers coupled to the user's left and right ears.

2. The method of claim 1 wherein the estimating a user's head size comprises:

providing, via a user device, instructions to a user for estimating the user's head size, and receiving, by the first and second microphones and after the instructions are provided, sound generated by the user.

3. The method of claim 2, wherein the providing instructions comprises:

instructing the user to make a sound or have another party make a sound at a location that is in a plane or along an axis that includes the user's left and right ears.

4. The method of claim 1, wherein the estimating a user's head size comprises:

detecting, by the first and second microphones, a plurality of sounds over a period of time, determining a time difference between detection of each of the plurality of sounds by the first and second microphones, and estimating the user's head size based on a maximum time difference.

5. The method of claim 1, wherein the at least one of identifying or modifying comprises identifying a HRTF associated with the user's head size, wherein the identifying comprises:

accessing a memory storing a plurality of HRTFs, and identifying a first one of the plurality of HRTFs corresponding to the user's head size.

6. The method of claim 5, wherein the memory is configured to store at least one of:

HRTFs corresponding to a small head size, a medium head size and a large head size, HRTFs corresponding to a plurality of different head diameters, or HRTFs corresponding to a plurality of different head circumferences.

7. The method of claim 5, further comprising:

determining, using the first and second microphones, a second user's head size; and accessing the memory to determine whether one of the plurality of HRTFs corresponds to the second user's head size.

8. The method of claim 7, further comprising:

at least one of generating a HRTF based on the second user's head size, in response to determining that none of the plurality of HRTFs stored in the memory corresponds to the second user's head size, or modifying one of the plurality of HRTFs based on the second user's head size, in response to determining that none of the plurality of HRTFs stored in the memory corresponds to the second user's head size.

9. The method of claim 1, further comprising:

determining the user's ear positions, and wherein the identifying a HRTF further comprises:

identifying the HRTF based on the user's ear positions.

10. The method of claim 1, wherein the estimating a user's head size is performed at least in part by an in-ear headset device or an over-the-ear headset device.

11. A device, comprising:

a memory configured to store a plurality of head-related transfer functions (HRTFs), each of the HRTFs being associated with a different head size; and a processor configured to:

receive time-related information associated with detecting a sound at a first microphone coupled to or located near a user's left ear, receive time-related information associated with detecting the sound at a second microphone coupled to or located near the user's right ear, determine a time difference between detection of the sound at the first microphone and detection of the sound at the second microphone, estimate a user's head size based on the time difference, at least one of a) identify a first HRTF associated with the user's head size, b) generate a first HRTF based on the user's head size, or c) modify an existing HRTF to provide a first HRTF based on the user's head size, and apply the first HRTF to audio signals to produce output signals; and a communication interface configured to forward the output signals to first and second speakers configured to provide sound to the user's left and right ears.

12. The device of claim 11, wherein the processor is further configured to:

output instructions for estimating the user's head size, and receive, by the first and second microphones and after the instructions are provided, sound generated by the user.

13. The device of claim 11, wherein when estimating a user's head size, the processor is configured to:

receive, via the first and second microphones, time related information associated with detecting a plurality of sounds over a period of time, determine a time difference between detection of each of the plurality of sounds by the first and second microphones, and estimate the user's head size based on a maximum time difference.

14. The device of claim 11, wherein the plurality of HRTFs includes at least HRTFs corresponding to a small head size, a medium head size and a large head size.

15. The device of claim 11, wherein the processor is further configured to:

estimate, using the first and second microphones, head size information associated with a second user, and determine whether one of the plurality of HRTFs stored in the memory corresponds to the second user's head size.

16. The device of claim 15, wherein the processor is further configured to:

at least one of generate a HRTF based on the second user's head size, in response to determining that none of the plurality of HRTFs corresponds to the second user's head size, or modify one of the plurality of HRTFs based on the second user's head size, in response to determining that none of the plurality of HRTFs corresponds to the second user's head size.

17. The device of claim 11, wherein the communication interface is configured to receive the plurality of HRTFs from an external device, and the processor is configured to store the HRTFs received from the external device in the memory.

18. The device of claim 11, further comprising:

a headset comprising:

a first speaker, a second speaker, a first microphone located adjacent the first speaker, and a second microphone located adjacent the second speaker.

19. The device of claim 11, wherein the device comprises a mobile terminal.

20. A system, comprising:

a headset comprising:

a right ear speaker, a left ear speaker, a first microphone coupled to the right ear speaker, and a second microphone coupled to the left ear speaker; and a user device configured to:

estimate a head size of a user wearing the headset based on a time difference associated with detection of sound received by the first and second microphones, and identify a head related transfer function (HRTF) to apply to audio signals provided to the right ear speaker and left ear speaker.

* * * * *